US006543055B2

(12) United States Patent
Howland et al.

(10) Patent No.: US 6,543,055 B2
(45) **Date of Patent: *Apr. 8, 2003**

(54) PENETRATION RESISTANT GARMENT

(75) Inventors: Charles A. Howland, Weston, MA (US); Virginia Howland, Weston, MA (US); Narain Schroeder, Nashua, NH (US)

(73) Assignee: Warwick Mills, Inc., New Ipswich, NH (US)

( * ) Notice: Subject to any disclaimer, the term of this patent is extended or adjusted under 35 U.S.C. 154(b) by 40 days.

This patent is subject to a terminal disclaimer.

(21) Appl. No.: 09/770,580

(22) Filed: Jan. 26, 2001

(65) Prior Publication Data

US 2001/0029621 A1 Oct. 18, 2001

Related U.S. Application Data

(62) Division of application No. 09/339,137, filed on Jun. 24, 1999.
(60) Provisional application No. 60/105,601, filed on Oct. 26, 1998.

(51) Int. Cl.[7] ..... F41H 1/02
(52) U.S. Cl. ..... 2/2.5; 428/911
(58) Field of Search ..... 2/2.5; 428/911

(56) References Cited

U.S. PATENT DOCUMENTS

| | | | | |
|---|---|---|---|---|
| 921,352 A | | 5/1909 | Blaker et al. | 2/2.5 |
| 1,282,411 A | | 10/1918 | Golembiowski | 2/2.5 |
| 4,403,012 A | | 9/1983 | Harpell et al. | |
| 4,648,136 A | | 3/1987 | Higuchi | 2/2.5 |
| 4,660,223 A | | 4/1987 | Fritch | 2/2.5 |
| 4,694,505 A | | 9/1987 | Flosi et al. | 2/2 |
| 5,185,195 A | | 2/1993 | Harpell et al. | |
| 5,198,280 A | | 3/1993 | Harpell et al. | |
| 5,515,541 A | | 5/1996 | Sacks et al. | 2/2.5 |
| 5,565,264 A | | 10/1996 | Howland | 442/189 |
| 5,677,029 A | * | 10/1997 | Prevorsek et al. | 428/113 |
| 5,738,925 A | | 4/1998 | Chaput | 428/101 |
| 5,824,940 A | * | 10/1998 | Chediak et al. | 89/36.05 |
| 5,837,623 A | | 11/1998 | Howland | 428/229 |
| 5,876,834 A | | 3/1999 | Foy et al. | |
| 5,881,395 A | | 3/1999 | Donzis | 2/455 |
| 5,976,996 A | | 11/1999 | Howland | 442/189 |
| 5,996,115 A | | 12/1999 | Mazelsky | 2/2.5 |
| 6,009,789 A | * | 1/2000 | Lyons | 89/36.02 |
| 6,035,438 A | | 3/2000 | Neal et al. | 2/2.5 |

FOREIGN PATENT DOCUMENTS

WO WO 01/29299 A3 4/2001

OTHER PUBLICATIONS

Warwick Mills Sales Brochure for TurtleSkin® WaterArmor™ 10K and TurtleSkin® WaterArmor™, 1999.

Web site printout for WaterArmor™, NBL Corp., 1999.

* cited by examiner

*Primary Examiner*—John Calvert
*Assistant Examiner*—Robert H. Muromoto, Jr.
(74) *Attorney, Agent, or Firm*—Vernon C. Maine; Maine & Asmus

(57) ABSTRACT

A penetration resistant garment that may be comfortably worn by a user while offering protection against injury from a penetrating object, such as a water jet for example, includes a plurality of light-weight, rigid, discrete penetration resistant sections cooperating with and arranged relative to one another to provide a flexible garment. The sections may be layered in an overlapping manner to provide substantially complete coverage extending over an area of desired coverage. Also, a length of the garment may be less than a sum of the lengths of the individual sections.

1 Claim, 13 Drawing Sheets

PENETRATION RESISTANT GARMENT

This application is a division of Ser. No. 09/339,137 filed Jun. 24, 1999 which claims the benefit of U.S. Provisional application Ser. No. 60/105,601, under 35 U.S.C. § 119(e), filed on Oct. 26, 1998, which is herein incorporated by reference in its entirety.

BACKGROUND OF THE INVENTION

1. Field of the Invention

This invention relates to penetration resistant garments and more particularly to lightweight, high-pressure water jet penetration resistant garments.

2. Related Art

Industrial tools utilizing high pressure water jets continue to be developed, such as, for example, metal working and cutting tools in which the water jet is fixed and the workpiece is moved relative to the water jet. Other tools, for example, hand-held gun-like water jet lances in which the operator moves the water jet over a stationary workpiece, have also been developed. These lances are used, for example, to remove coatings, such as paint, from metallic surfaces. In both types of tools, high pressure water pumps capable of delivering up to 40,000 psi supplies the high pressure water to the jet. With increased operating pressures, the overall horsepower of the pumps has also increased, which has resulted in an increase in water flow rates.

The increase in pressure and flow has increased the risk of serious injury from direct cuts or amputations and infections, especially when using the hand-held water jet lance, for example. Not only does the water jet contain very large energies that will penetrate body tissue very aggressively, the water jet may carry dirt and bacteria into the wound beyond the region of obvious tissue damage.

The water jet can be thought of as a needle-like penetrator because the diameter of the jet is small. However, unlike a needle, which is defeated when the tip is bent, a water jet continuously renews the sharp focus of penetration. Conventional cut resistant or bullet proof garments offer little protection from a water jet because the fabrics used in such garments are readily cut and eroded by the jet's small intense contact point such that full penetration may occur. In general, once penetration has started, the erosive effect of the water jet destroys all of the remaining fabric at the contact point. As a result, the use of high performance fabrics having open, flexible weaves make such fabrics poor candidates for use in protective garments for water jet applications.

Rigid steel or aluminum would offer protection from the erosion of the water jet. However, in addition to the added weight, such materials significantly compromise comfort and freedom of motion and thus are generally not suitable for use in protective garments, especially in industrial environments where such characteristics are necessary.

Given the risk in this industry, a number of attempts at safety garments have been developed. DuPont and others, for example, have developed lined suits using penetration resistant fabrics. An example of such a fabric is disclosed in U.S. Pat. Nos. 5,565,264 and 5,837,623, which are assigned to the present assignee and which are incorporated herein by reference in their entireties. The suits made from such fabrics are shaped and formed using conventional techniques. For example, the front of the pant of the suit is cut from a continuous piece of the penetration resistant fabric. Alternatively, the penetration resistant fabric may be added as a liner following the basic shape of the outer layer of the garment.

To provide a desired level of penetration resistance while retaining some flexibility, multiple layers of penetration resistant fabric are used. However, these added layers significantly add to the cost and weight of the garment. In addition, the suits, which cover the entire body, tend to hold heat and reduce the evaporative cooling of the wearer, which may result in heat stress.

SUMMARY OF THE INVENTION

One aspect of the present invention is directed to a penetration resistant garment for use, for example, in the water jet industry that may be comfortably worn by a user while offering protection against injury from a penetrating object such as a water jet. The penetration resistance of a single layer of the penetration resistant fabric for use in a penetration resistant garment, may be significantly increased when a coating is applied to the fabric. However, the coating may result in a significantly stiff fabric, which may be less desirable for use as a continuous piece of fabric in a penetration resistant garment.

Thus, in one embodiment, a penetration resistant garment includes a plurality of lightweight, rigid, discrete penetration resistant sections cooperating with and arranged relative to one another to provide a flexible garment. In another embodiment, the penetration resistant garment includes a plurality of penetration resistant panels cooperating with and arranged relative to one another to provide substantially complete coverage. In yet another aspect of the invention, the panels each have a length. The panels cooperate with and are arranged relative to one another such that a length of the garment is less than a sum of the lengths of the individual panels.

In still another aspect of the invention, the penetration resistant garment includes a first panel and a second panel joined to the first panel to define a length. The panels are adjustable relative to one another to selectively adjust the length of the panels.

In yet another aspect of the invention, the penetration resistant garment includes an undergarment having penetration resistant properties and a cover removably attached to the undergarment.

In another aspect of the invention, the penetration resistant garment includes a penetrating resistant fabric and a hardening material cooperating with the fabric.

In yet another aspect of the invention, the penetration resistant garment includes a penetration resistant fabric forming the garment. The garment is adapted to be worn exclusively on the front or the back of the user.

In still another aspect of the invention, the penetration resistant garment includes a first panel, a second panel and a knee pad coupled between the first and second panels. The knee pad is pivotally connected to the first panel about a first pivot axis and pivotally connected to the second panel about a second pivot axis. The axes are positioned through the knee pad at predetermined locations such that an effective center of rotation of the first panel, the second panel and the knee pad passes through a center of rotation of the knee of a wearer.

In yet another aspect of the invention, a method of donning at least a section of a penetration resistant garment on a wearer is disclosed. The section includes a knee section having a knee pad, a first panel pivotally connected to the knee pad and a second panel pivotally connected to the knee pad. The section further includes a thigh section adapted to be adjustable relative to the first panel of the knee section. The method includes the steps of first securing the knee section to the wearer, then attaching the thigh section to the first panel of the knee section. In this manner, the garment may be readily sized for different sized wearers.

In another aspect of the invention, a panel construction use in a penetration resistant garment is disclosed. The panel construction includes a backing and a penetration resistant material covering the backing. The penetration resistant material occupies an area less than a total area of the backing.

In yet another aspect of the invention, a panel construction for use in a penetration resistant garment is disclosed. The panel construction includes a backing and a penetration resistant material covering the backing. A laminate is disposed over the penetration resistant material.

In still another aspect of the invention, a kit of parts for use in assembling at least a portion of a penetration resistant garment is disclosed. The kit includes at least one penetration resistant panel. The panel is adapted to cooperate with an arranged relative to an adjacent panel to provide substantially complete coverage.

In a further aspect of the invention, a panel construction for use in a penetration resistant garment is disclosed. The panel construction includes a backing and at least two layers of penetration resistant material covering the backing.

Various embodiments of the present invention provide certain advantages and overcome certain drawbacks of the conventional techniques. Not all embodiments of the invention share the same advantages and those that do may not share them under all circumstances. This being said, the present invention provides numerous advantages including the noted advantage of increased protection with decreased physical and heat stress to the wearer.

Further features and advantages of the present invention as well as the structure and operation of various embodiments of the present invention are described in detail below with reference to the accompanying drawings.

BRIEF DESCRIPTION OF THE DRAWINGS

The invention will now be described, by way of example, with reference to the accompanying drawings, in which.

DETAILED DESCRIPTION

A penetration resistant garment that may be comfortably worn by a user while offering protection against injury from a penetrating object, such as a water jet for example, includes a plurality of light-weight, rigid, discrete penetration resistant sections cooperating with each other to provide a flexible garment offering substantially complete coverage extending over an area of desired coverage. The sections or panels may be layered in an overlapping manner to provide the substantially complete coverage for the garment such that a length of the garment is less than a sum of the lengths of the individual sections or panels to aid in protecting the wearer from penetration while keeping the wearer dry and clean. Sufficient overlap is provided to maintain adequate coverage of the wearer when the garment is bent during use as the wearer bends. In one embodiment, the panels are arranged to overlap in a vertical manner from the top of the garment to the bottom to reduce the likelihood that water will run behind the garment onto the wearer.

Although reference is made to use of the present invention for added protection when using a water jet, the present invention may be used in any environment requiring added protection from penetration of other fluids or objects.

Figure 1:
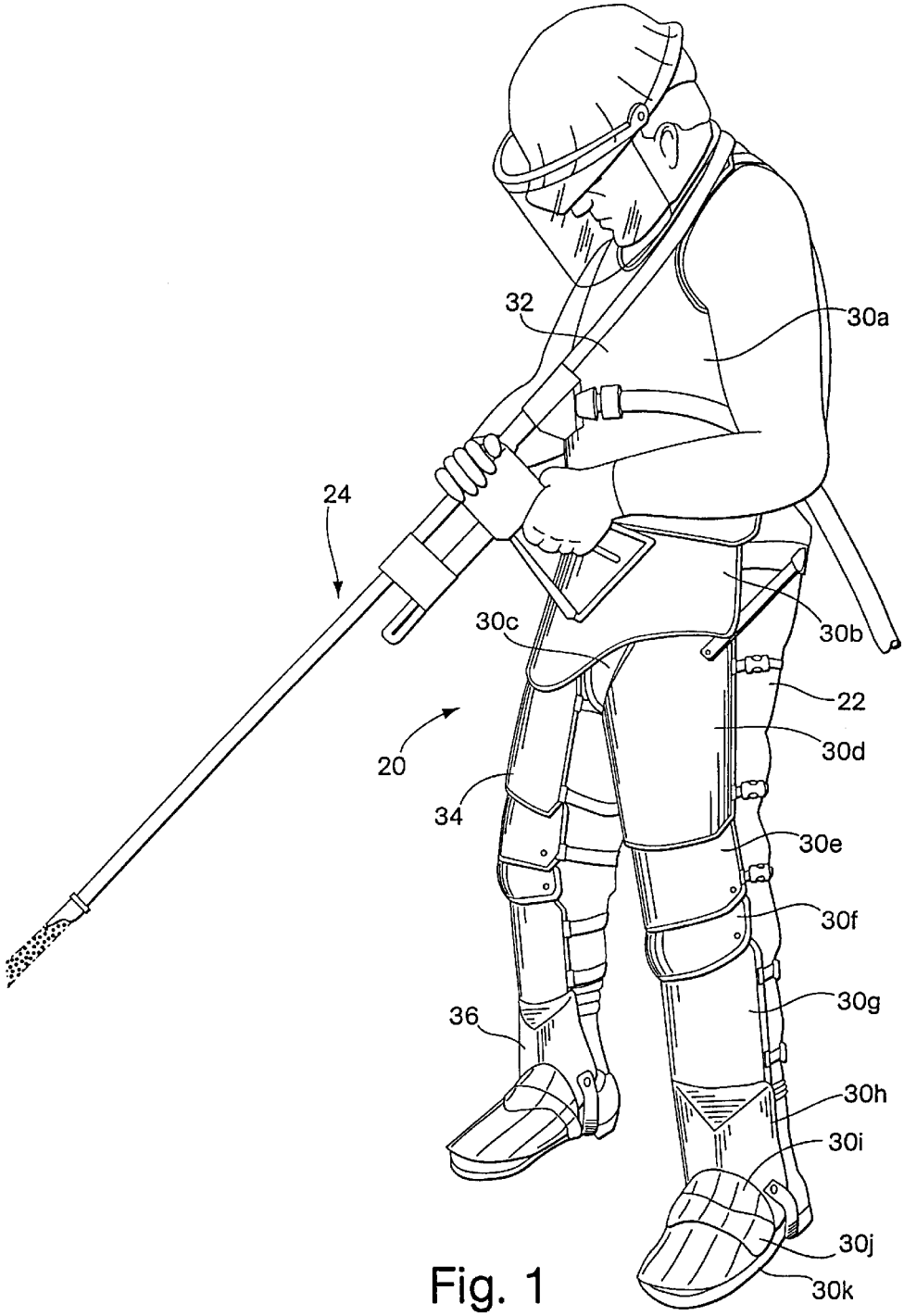
FIG. 1 is a perspective view of a penetration resistant garment according to one embodiment of the present invention shown on a wearer.

FIG. 1 is a perspective view of the penetration resistant garment 20 according to the present invention shown worn by a wearer 22 using a lance-type water jet device 24. The garment 20 includes a plurality of penetration resistant panels 30, shown as 30*a*–30*k* and collectively referred to as panels 30, a torso section 32 (shown in more detail in FIGS. 2–4), a chaps section 34 (shown in more detail in FIGS. 5–7), and a gaiter section 36 (shown in more detail in FIGS. 8–10). Although only three sections are shown and described herein, it is to be appreciated that other sections covering other parts of the wearer's body may be provided using the construction of the present invention. For example, arm sections may be provided, which may be constructed and arranged similar to the thigh section and knee section, thereby allowing bending of the wearer's arm. The shoulder and neck may be protected with separate panels joined to the torso section. In addition, although the garment described herein is adapted for use with a human, the panels may be arranged to conform to the shape of any desired animal that may be used in environments requiring protection.

According to one aspect of the invention, the panels 30 cooperate with one another in a manner such that the garment 20 remains flexible. In one embodiment, as will be fully described hereinafter, the panels slide relative to one another. In another embodiment, the panels are pivotally connected to one another. In any event, it is to be appreciated that the panels, which individually may be rigid, cooperate in a manner such that the overall garment is flexible and therefore comfortable for the wearer.

Figure 2:
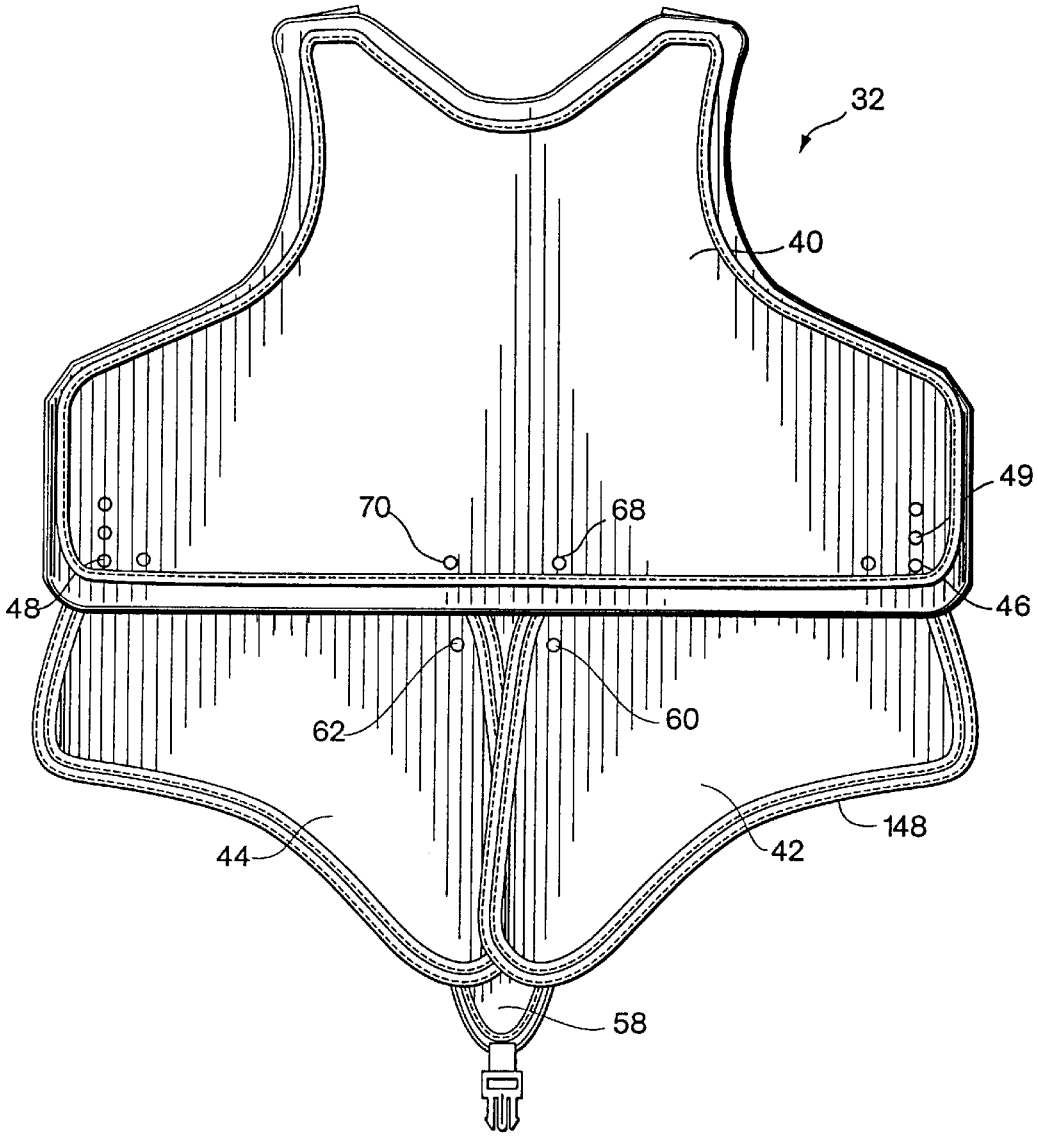
FIG. 2 is a front view of a torso section of the garment of FIG. 1.
Figure 3:
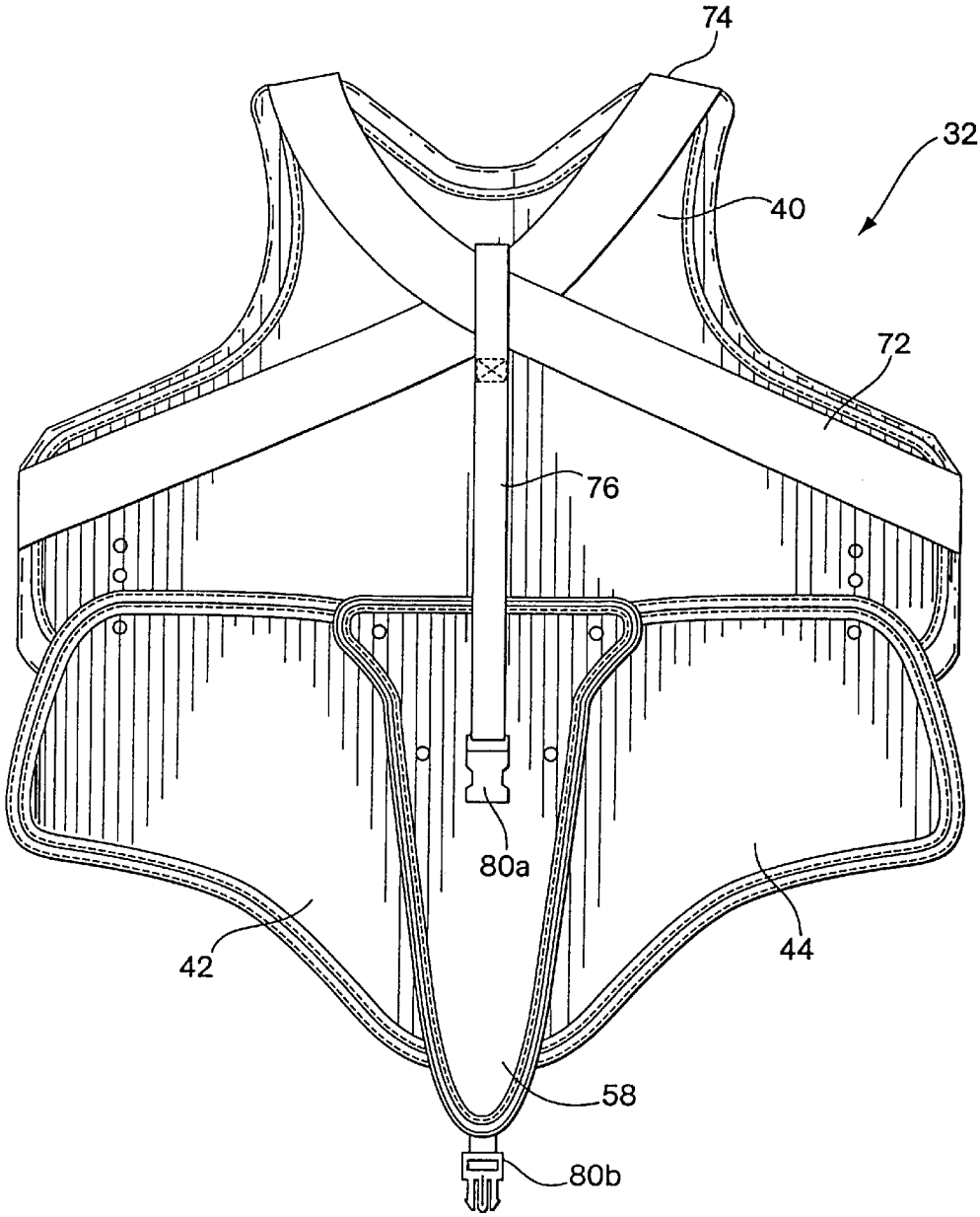
FIG. 3 is a rear view of the torso section of FIG. 2.
Figure 4:
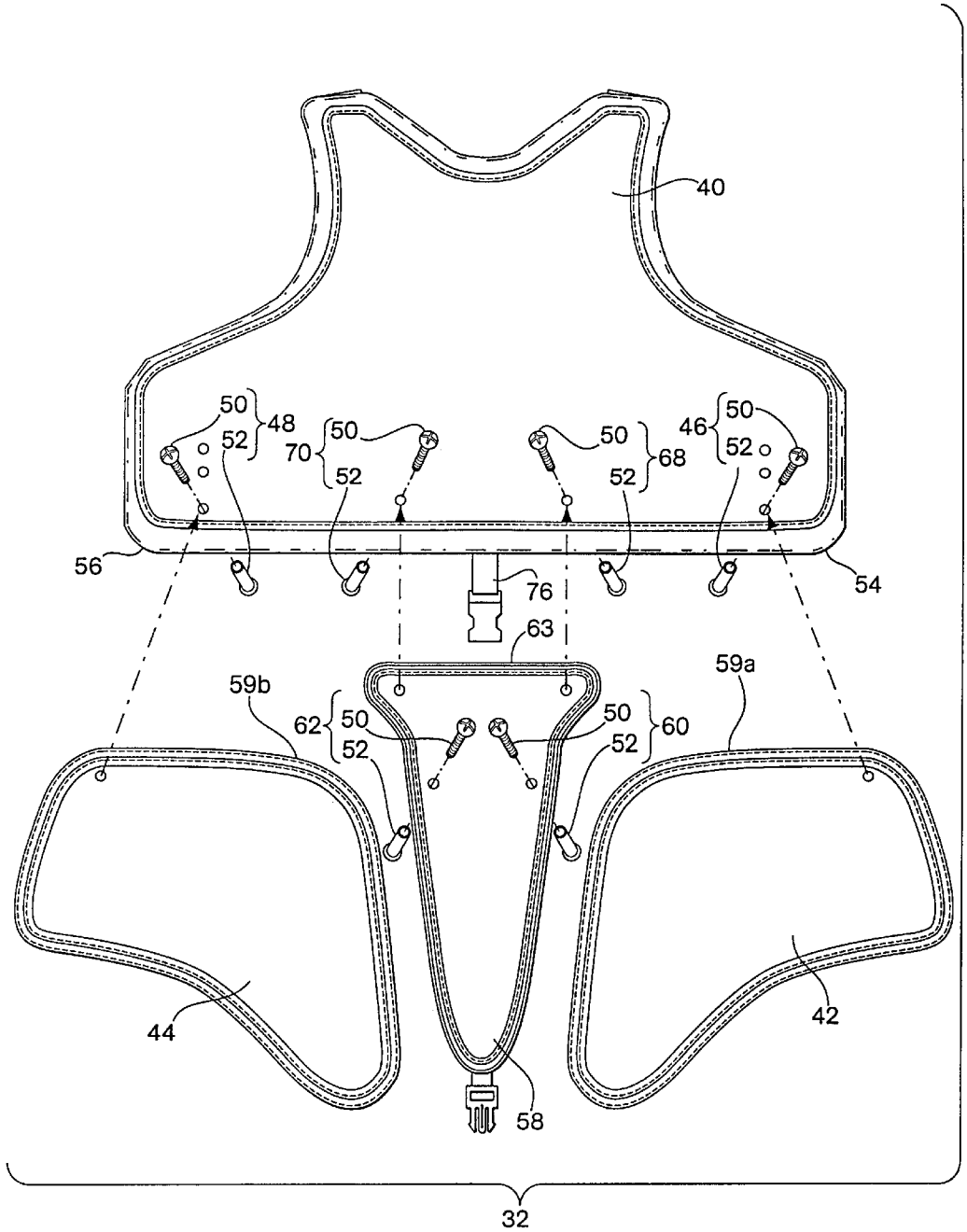
FIG. 4 is an exploded view of the torso section of FIG. 2.

Referring now to FIGS. 2–4, the torso section 32 includes a chest panel 40 generally shaped according to the chest of a wearer. The torso section 32 also includes a left waist panel 42 and a right waist panel 44, both coupled to the chest panel and both generally shaped to conform to the waist area and hip area of a wearer. Preferably, the waist panels are coupled to the chest panel with the use of pivot pins 46, 48 passing through respective holes formed in the panels. To provide adjustability in the length of the torso section, a plurality of fastening locations may be provided. For example, a plurality of holes 49 may be provided. The pivot pins may be any suitable fastener. Preferably, the fastener permits pivoting of the two panels and, as will be described hereinafter, allows removing and replacing a panel. In one embodiment, the fasteners are formed by a screw 50 and "T" nut 52 (see FIG. 4). Other fastening means envisioned include a snap fastener or a rivet. The waist panels 42 and 44 are attached to the chest panel at outside portions 54 and 56, respectively. As a result, when the torso section is placed on the wearer and wrapped around the waist of the wearer to conform to the upper body, the waist panels are permitted to pivot about the pivot pins to allow increased flexibility of the garment.

If pivoting between the waist panels and the chest panel is not a requirement, for example, if the user is not required to bend, but adjustability is desired, other suitable fasteners may be used, such as a hook and loop fastener (not shown). As will be discussed with reference to the thigh section, the hook and loop fastener may provide adjustability in the overall length of two adjacent panels while also securing them together. Thus, in this regard, the chest panel 40 may be adjusted relative to the waist panels by positioning and attaching the hook and loop fastener at a desired fastening location.

The torso section 32 also may include a groin panel 58 coupled between the waist panels and attached to the waist panels at inside portions 59*a* and 59*b,* respectively, of the waist panels with pivot pins 60, 62. The groin panel 58 also is attached to the chest panel at an upper location 63 of the groin panel with pivot pins 68, 70. The pivot pins may be any suitable fasteners as described above. In the embodiment described herein, the pivot pins are formed by a screw and a "T" nut. Of course, the groin panel may be adjustable relative to the chest and waist panels in a similar manner as described above with reference to the waist panels.

As best shown in FIG. 3, shoulder straps 72, 74, which may be made of any suitable material such as a woven web, are attached to the chest panel 40 to allow the torso section to be worn like a vest. The straps may criss-cross to provide greater secureness of the torso section to the wearer. However, according to one aspect of the invention, the torso section preferably is loosely fit on the wearer to provide for air flow between the garment and the wearer to allow for adequate cooling of the wearer. In addition, the straps may be adjustable provided that the wearer is able to maintain adequate air flow between his or her body and the garment. Although according to one embodiment the garment may be adapted to be worn exclusively on the front or back of a wearer for added cooling, the back and buttocks may be protected by additional panels as desired. In such an embodiment, the garment portions protecting the back and buttocks also preferably are loosely fit on the wearer.

To secure the bottom portion of the torso section to the wearer, a third strap 76 may be used. In one embodiment, the strap may be secured to the bottom section 78 of the groin panel 58 and attached to the straps 72, 74. This strap also may be adjustable as described above. In addition, the strap may include a snap buckle 80*a,* 80*b* to provide ease of placing the torso section on the wearer.

Figure 5:
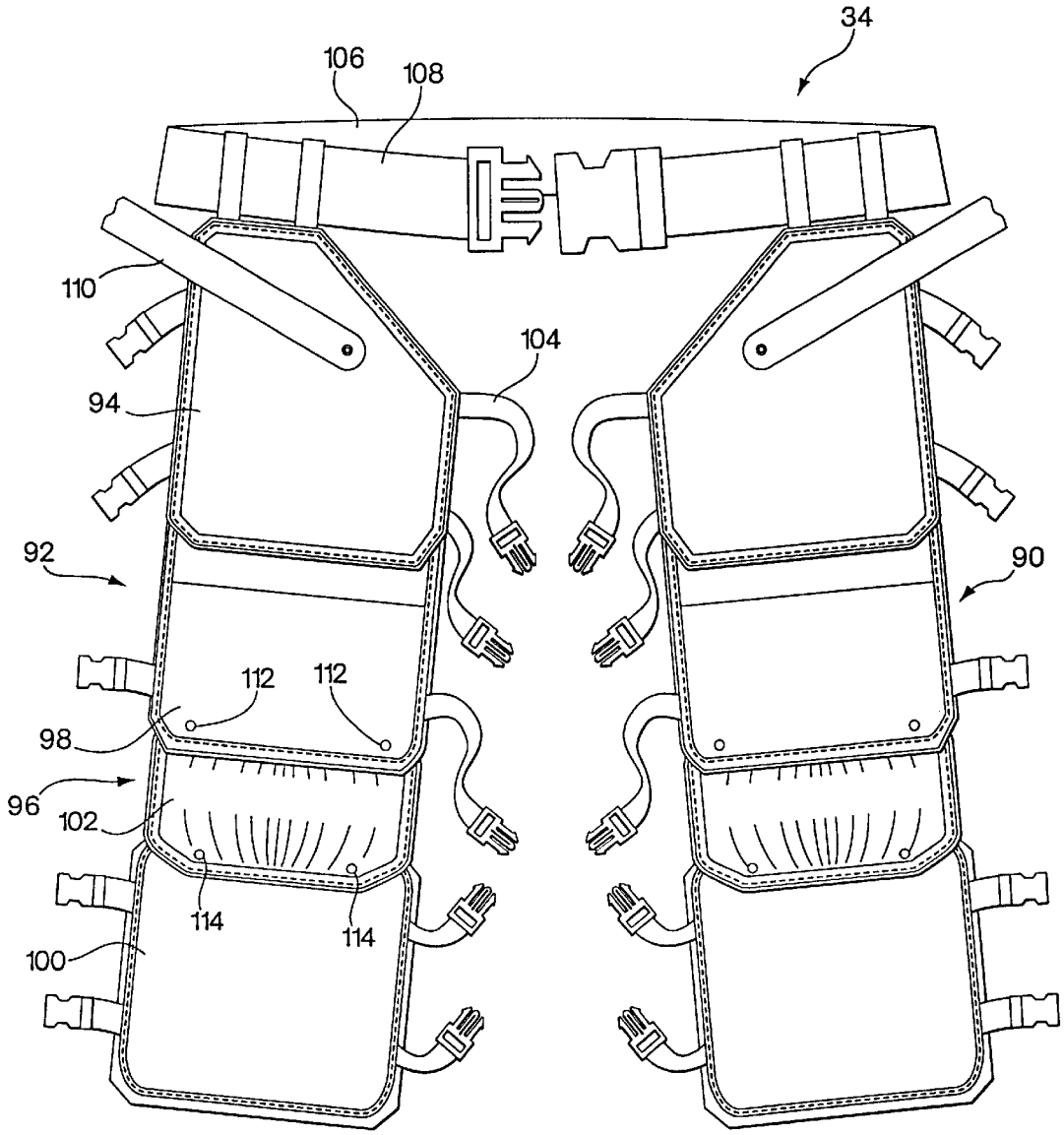
FIG. 5 is a front view of a chaps section of the garment of FIG. 1.
Figure 6:
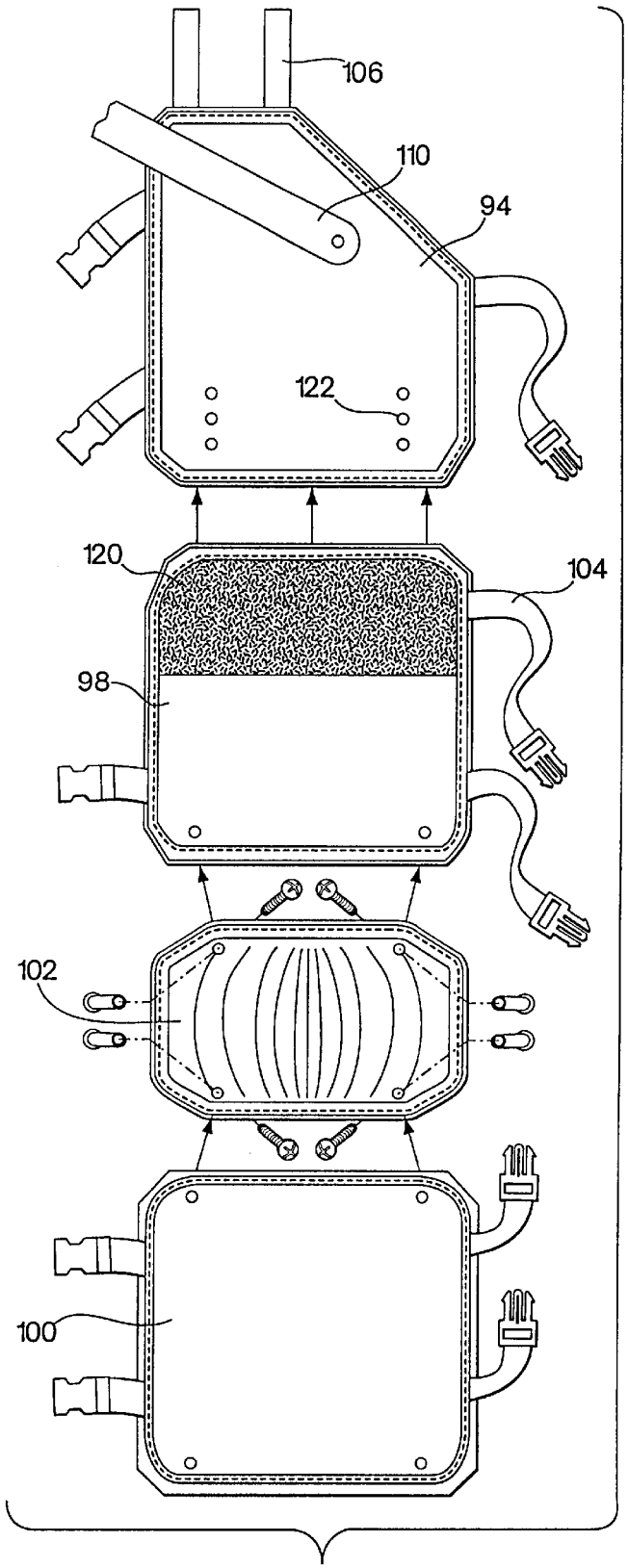
FIG. 6 is an exploded view of a leg section of the chaps section of FIG. 5.
Figure 7:
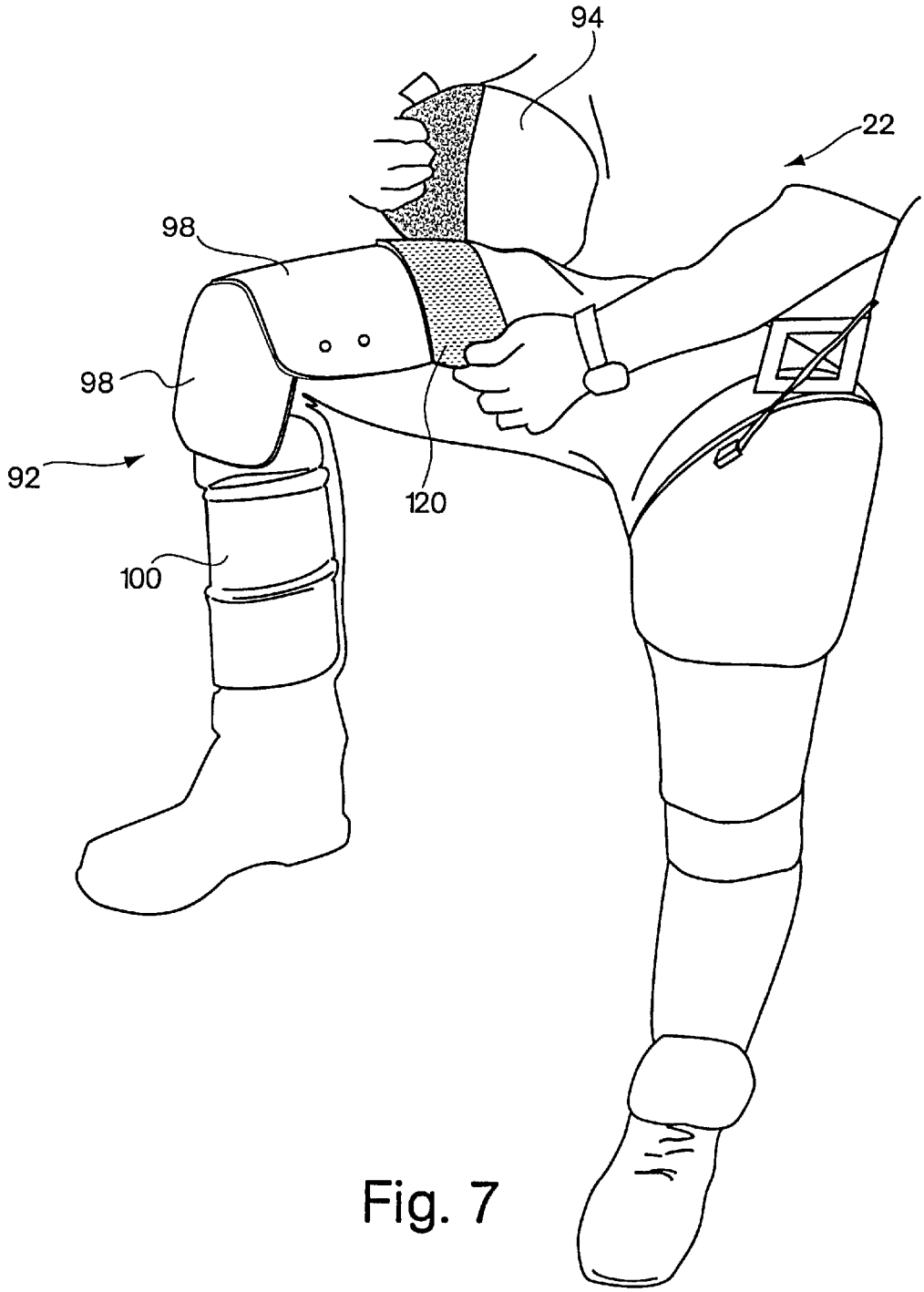
FIG. 7 is perspective view showing adjustment of the chaps section according to the present invention.

Referring now to FIGS. 5–7, the panels are configured to form a chaps section 34. The chaps section includes first 90 and second 92 leg sections. For the sake of convenience, the construction and arrangement of the chaps section will be discussed with reference to one leg section with the understanding that the other leg section is of similar construction and arrangement. Although it is to be appreciated that the leg sections discussed herein are similar, they may be adapted slightly to accommodate the left or right leg or may be constructed and arranged to offer greater protection to one leg or to certain areas of the leg, as may be desired. In addition, although the chaps section described herein provides added protection to the front of the legs only, the back of the legs may be protected with or without front leg protection by additional or alternative panels as desired.

Each leg section includes a thigh section 94, which, in this example, is constructed from one panel, and a knee section 96. The knee section 96 includes an upper knee panel 98, a lower knee panel 100 and a knee pad 102 coupled between the upper and lower panels. The upper panel is adjustably secured to the thigh panel. One or more straps 104 with associated buckles may be used to secure the chaps section to the leg of the wearer and may be held up with one or more loops 106, which may be used to attach the chaps section to a belt 108. In one embodiment, the straps 104 are adjustable in a manner described above with respect to the torso section 32 and may or may not be formed of elastic webbing. In any event, preferably, the chaps section is loosely held to the legs so as to allow adequate air flow for cooling. An outhaul strap 10 may also be provided to restrict movement or rotation of a leg section toward the inner thigh of the wearer. The strap may include a buckle to adjust the length of the strap to accommodate the height of the user.

As shown in FIG. 1, the torso section is constructed and arranged to sufficiently overlie the chaps section to offer adequate protection and water shedding, even as the wearer bends. In addition, the torso section is permitted to slide relative to the chaps section to provide the wearer with unrestricted movement while bending or turning.

The knee section 96 includes a first pair of pivot pins 112 pivotally securing the knee pad 102 to the upper knee panel 98 about a first pivot axis and a second pair of pivot pins 114 pivotally securing the knee pad 104 to the lower panel 100 about a second pivot axis. The first and second pairs of pivot pins may be positioned through the knee pad at predetermined locations such that an effective center of rotation of the upper panel, the lower panel and the knee pad passes through a center of rotation of the knee of a wearer. Of course, as described with reference to the torso section, the pivot pins may be formed of any suitable fastener such as a screw and "T" nut or snap fasteners. Hook and loop fasteners may be used if pivoting is not a requirement.

As best shown in FIGS. 6 and 7, the upper knee panel 98 may be adjustably secured to the thigh panel 94 with the use of a hook and loop fastener 120. In this manner, the length of the leg section 92 may be fitted to the wearer by moving the location of the attachment area of the hook and loop fastener. Of course, those skilled in the art will recognize that other fasteners may be used to adjust the length of the leg section. For example, a plurality of mounting holes 122 may be formed in the thigh panel to receive a snap fastener, a rivet, a screw and "T" nut or the like. The preferred amount of adjustment accommodates wearers having an inseam length of 24" to 38". Accordingly, the amount of overlap is about 4" to 6". As described above with reference to the torso section, any of the panels forming a leg section may be replaced as desired. The chaps section may be donned by first securing the knee section to the wearer, then attaching the thigh panel to the first panel of the knee section. In this manner, the chaps section may be readily sized for different sized wearers.

Figure 8:
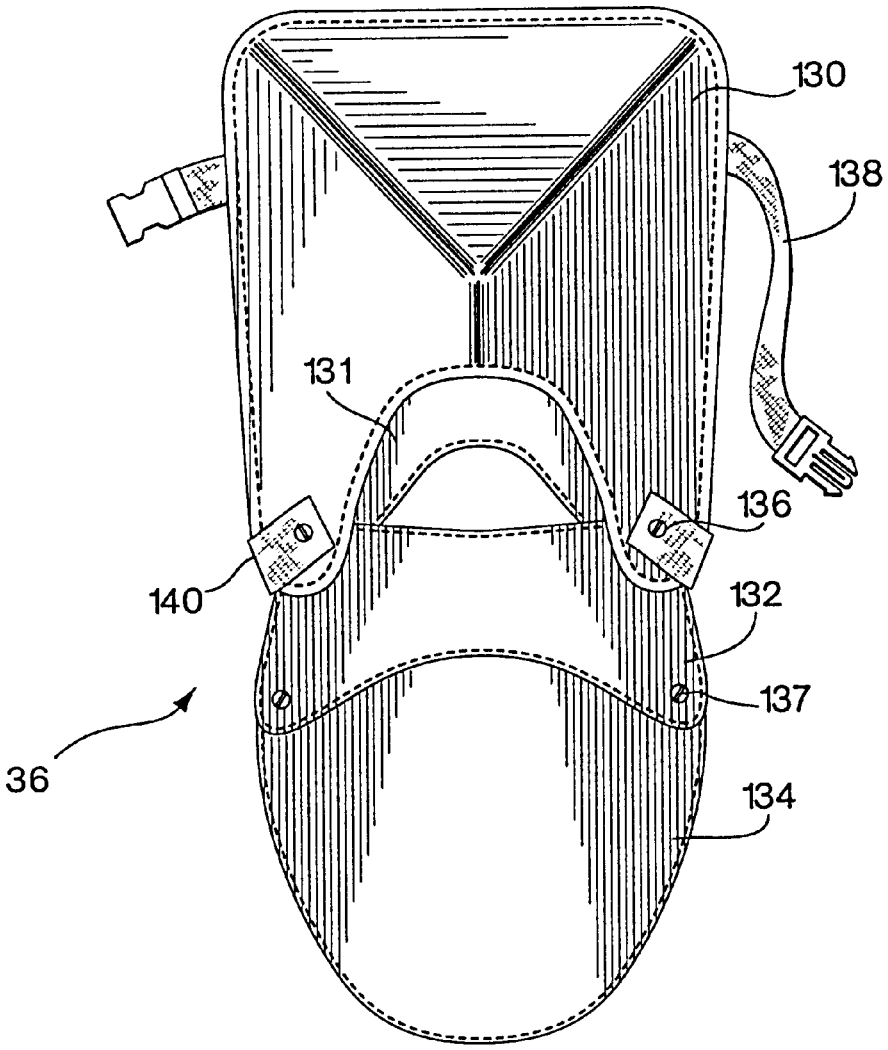
FIG. 8 is a front view of a gaiter section of the garment of FIG. 1.
Figure 9:
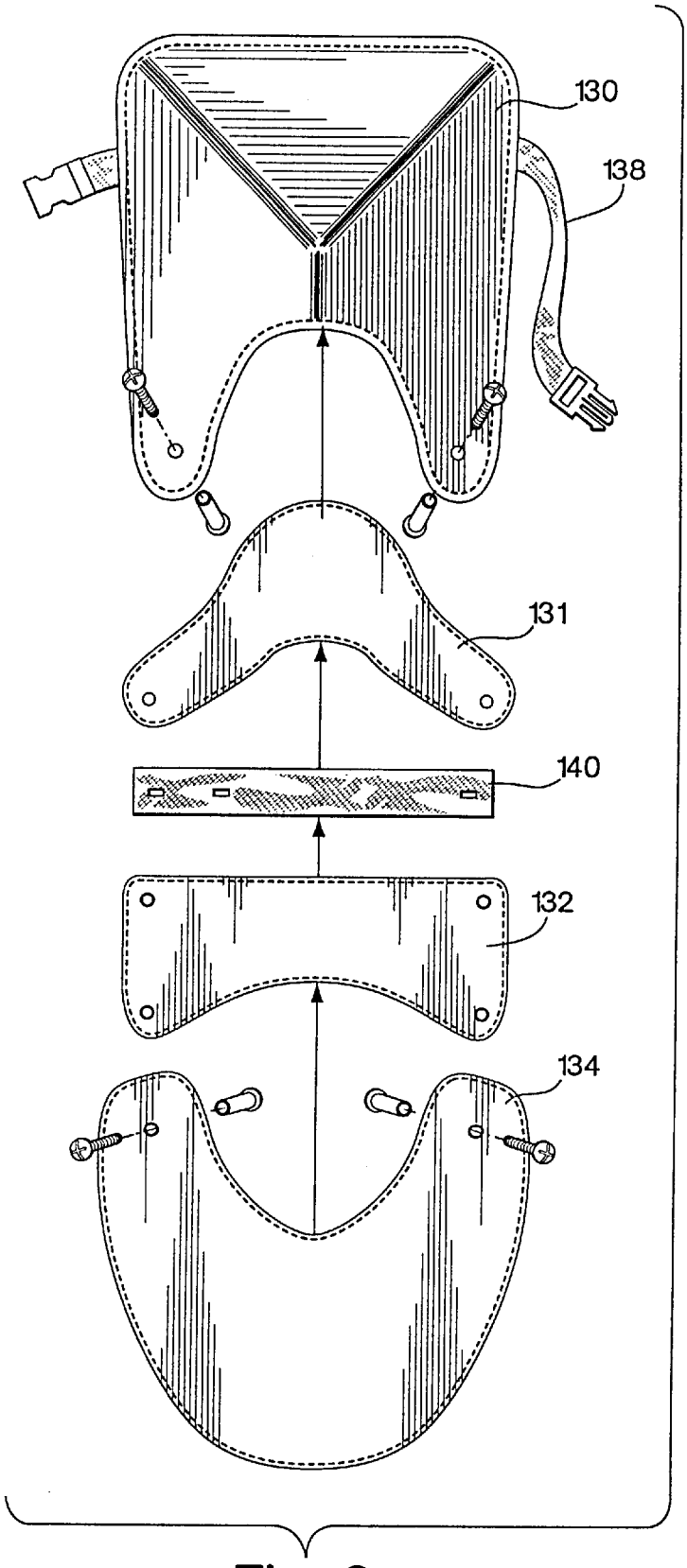
FIG. 9 is an exploded view of the gaiter section of FIG. 8.
Figure 10:
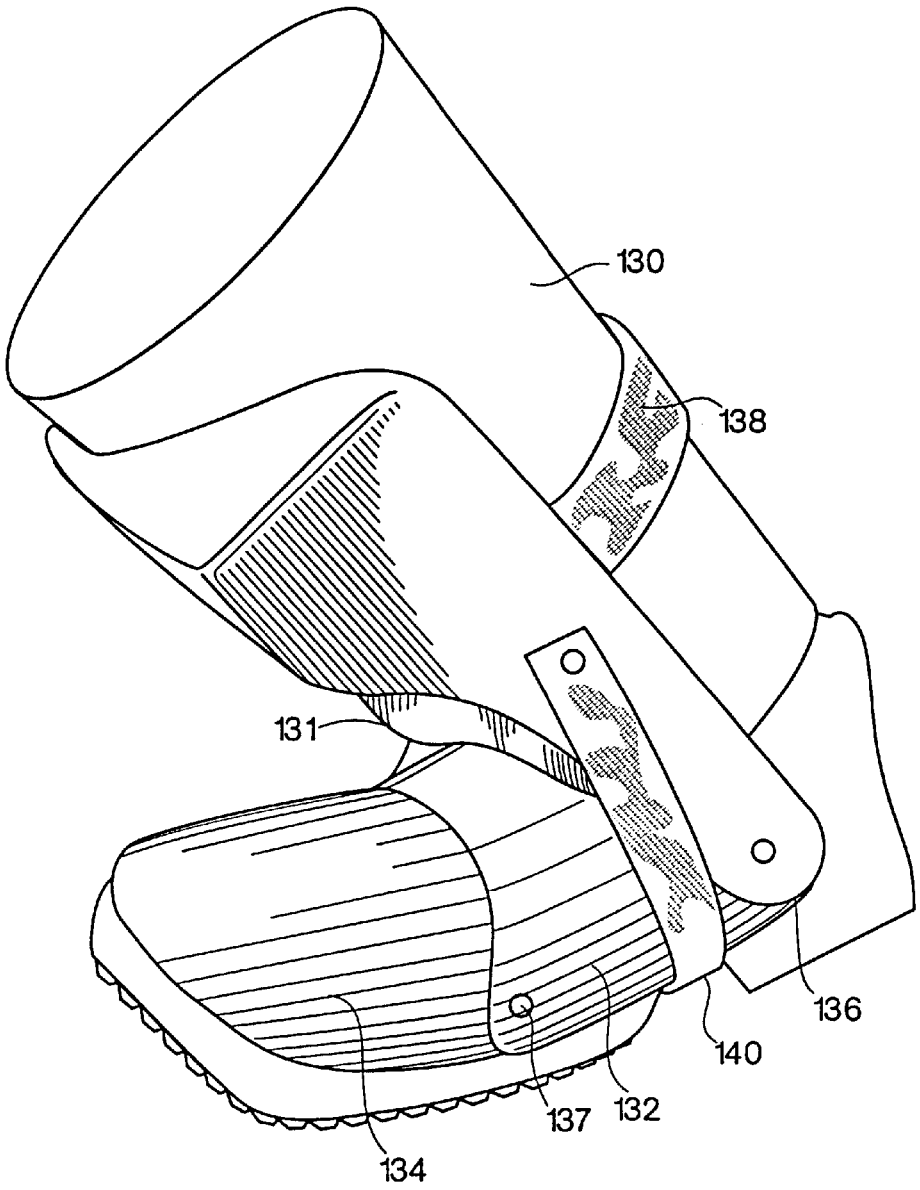
FIG. 10 is a perspective view of the gaiter section of FIG. 8.

Referring now to FIGS. 8–10, the garment 20 further includes a gaiter section 36. The gaiter section 36 includes first and second shin panels 130, 131, an ankle panel 132 and a foot panel 134. In one embodiment, the foot panel 134 is adapted to extend up to the steel toe of the shoe of the wearer. The shin panels and the ankle panel are secured together with pivot pins 136 at a position adapted to allow ankle rotation of the gaiter section when worn by a wearer. The two shin panels are shaped with similar arc sections such that upon bending by the wearer, the second shin panel 131 is able to slide, at least partially, under the first shin panel 130 as can be seen in FIG. 10. Although two shin panels are shown and described, it is to be appreciated that only one shin panel may be provided. The ankle panel and the foot panel are secured together with similar pivot pins 137 at a second hinge point that coincides with the ball area of the user's foot such that the user may articulate the foot at the toe area as shown in FIG. 10. With such a double hinge arrangement, the gaiter section allows the user to bend to a maximum extent.

The pivot pins 136 may be formed of any suitable fastener as described above, such as a screw and "T" nut shown. One or more straps 138 may be provided to secure the gaiter section. In addition, a heel strap 140, which may be formed of an elastic webbing or band, may be used to secure the heel area of the gaiter section. The heel strap may be fixed to pivot pins 136, as shown in FIG. 8, or may be attached at any other suitable location on the gaiter section, such as the shin panel 130, as shown in FIG. 10. Preferably, the chaps section 34 is adapted to cover the shin panel 130 to provide a garment having continuous coverage.

With the cooperation of one panel to one or more adjacent panels, the garment may provide substantially complete coverage over a desired area of protection of the user. Thus, the panels are arranged in any suitable manner such that a full coverage of a selected area is possible while a single panel may cover less than the desired area.

According to another aspect of the invention, the garment may be provided in a kit of parts containing at least some of the individual panels, fasteners, and straps to allow a user to assemble and wear the garment once it has been partially or completely assembled. Also, replacement parts may be provided in one or more kits. The kits may also be provided with selected components such that a user may arrange a specific assembly suitable for a specific need.

In one embodiment, the panels have curved corners for added comfort and the panels themselves may be curved to conform to the particular body part for which the panel protects. In addition, the sides on some panels are curved and complement the shape of adjacent panels. For example, the waist panels are formed with a concave side 148 (see FIG. 2) on a side of the panel facing the lower and outer thigh of the wearer's leg so as to complement the bend formed on the chaps that offers protection to the inner and outer leg. The concave side of the waist panels and the bend formed on the chaps may also facilitate sliding of the waist panels over the chaps without binding. Also, the groin panel is formed as an elongated panel having curved edges to provide protection when the wearer's knees are straight and when they are bent without causing binding or otherwise constraining the wearer.

Figure 11:
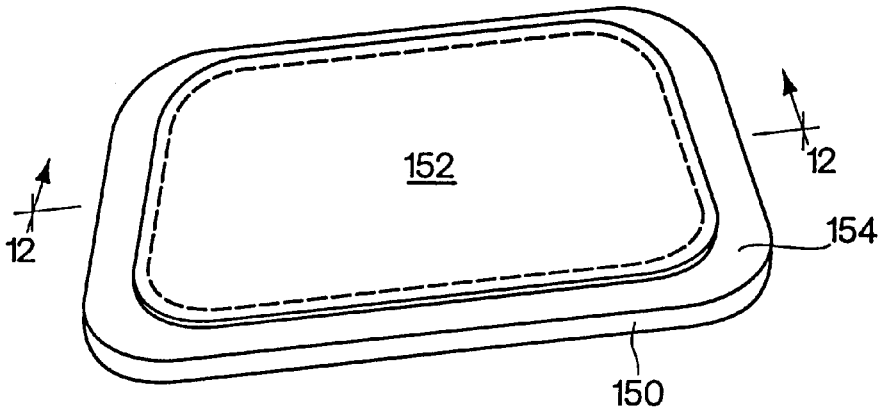
FIG. 11 is a perspective view of single panel of the garment according to the present invention.

As shown in FIGS. 11 and 12, each panel may include a backing 150, with the penetration resistant material 152 covering the backing. The penetration resistant material occupies an area less than a total area of the backing. The penetration resistant material may cover the backing such that an edge 154 of the backing remains exposed. The backing may be formed of a closed cell low moisture polyethylene foam material or a polyester material. The backing provides added comfort to the wearer and the exposed edge reduces discomfort if the panels wedge into a body part, such as, for example, the thigh, of the wearer. A liner 156 formed of a soft fabric may be used to cover the foam. Preferably, the liner is made of polypropylene or polyester filament fabrics, however, any fabric that is easy to clean and provides low or no water retention may be used.

The penetration resistant material 152 of the present invention may be formed of an ultra-tight woven fabric material made of high tenacity yams, such as that developed by the inventors of the present invention and disclosed in U.S. Pat. Nos. 5,565,264 and 5,837,623. Other suitable fabrics made of high strength fibers of greater than 8 grams per denier and less than 10% elongation at break may be used. Examples of such fibers includes: para-arimid fibers including, for example, Kevlar®, manufactured by Du Pont, Charlotte, N.C.; Twarmon®, manufactured by AXZO Nobel Industrial Fibers, Inc., Scottsboro, Ala.; Technoroa®, manufactured by Teijan, Osaka, Japan; Trevir® manufactured by Kosa, Charlotte, N.C.; ultra high molecular polyethylene fibers including, for example, Spectra®, manufactured by AlliedSignal Inc., Atlanta, Ga.; Dynema®, manufactured by DSM "The Polymer Corp.", Reading, Pa.; Certran®, which may be manufactured by Hoescht Celenese, Salisburg, N.C.; Vectran® fibers, manufactured by Hoescht Celenese, Salisburg, N.C.; carbon fiber; or glass fibers.

To increase the penetration resistance of the material 152, the material may cooperate with a hardening material. For example, the hardening material may be coated on the penetration resistant fabric or may be saturated therein. In addition, the hardening material may include a filler of a crystalline material adhered thereto. The epoxy and filler provide resistance to the erosive effect of the water jet. Examples of such an epoxy include epoxy resins, cross-linked polyester resins and also polyether resins. Examples of such a crystalline material includes ceramic, garnet, metal, silicon carbide, aluminum oxide and diamond. The crystalline material may be in a fine grain powder form and may have a mesh size of at least 150 or finer, for example, 600.

Preferably, the penetration resistant fabric has a very tight woven construction. Saturation and/or coatings and/or laminations and/or calendaring may be used to further bind the filaments of the fabric together. However, any material that is added to the woven fabric should have excellent adhesion to the fiber. For example, the use of an epoxy when using a para-arimid provides adequate adhesion.

Figure 12A:
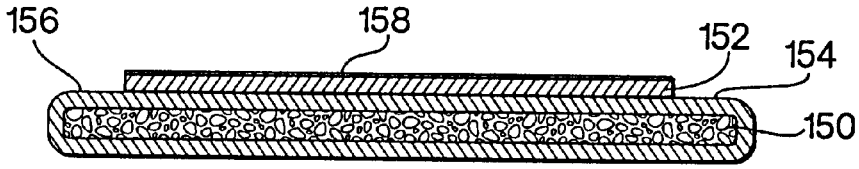
FIGS. 12*a* and 12*b* are cross-sectional views of alternative embodiments of the panel taken along line 12—12 of FIG. 11.

In another embodiment, also shown in FIG. 12*a,* which is a cross-sectional view of FIG. 11 taken along line 12—12, a laminate 158 may be disposed over the penetration resistant material to allow ease of water shedding and cleaning. The laminate may be formed of a low friction material, such as polypropylene, and may have a thickness of about 2 mils. In another embodiment, the laminate may be formed as a woven material that is hot glued and stitched to the penetration resistant fabric. Preferably, this laminate fabric provides high durability and abrasion resistance. In one embodiment, the fabric used in the laminate may include synthetic yams, which may be made up of individual filaments or multiple filaments. Each filament may have a denier of not less than 50.

Figure 12B:
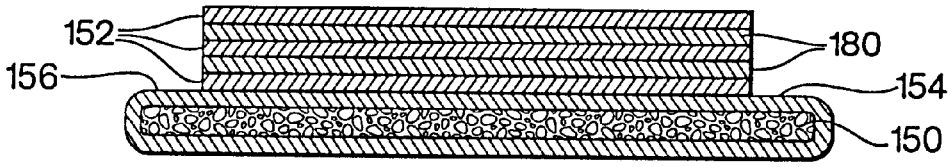

In another embodiment, as shown in FIG. 12*b,* which is a cross-sectional view of an alternative embodiment of FIG. 11 taken along line 12—12, the panel may be constructed of multiple layers of penetration resistant fabric 152. In addition, to further increase the penetration resistance of the garment, a spacer material 180 may be placed between two or more layers of the penetration resistant material 152. In this regard, the spacer material may alternate between single layers of the penetration resistant material 152 or between multiple layers of the penetration resistant material 152. The spacer material 180 preferably deflects and distorts the water jet hitting the garment as the water jet penetrates the outer layer. In one embodiment, the spacer material separates the layers by a distance of about .015" to about .025".

The spacer may be formed of a fabric composed of synthetic yarns. The yarns may be made up of individual filaments or multiple filaments. Each filament may have a denier of not less than 50. Alternatively, the spacer 180 may be formed of a fibrous felt or foam having, in part, synthetic yarns. In another alternative, the spacer may be formed of both a synthetic yarn (made of individual or multiple filaments having a denier not less than 50) and the fibrous felt or foam and may be formed in a layered construction.

Figure 13:
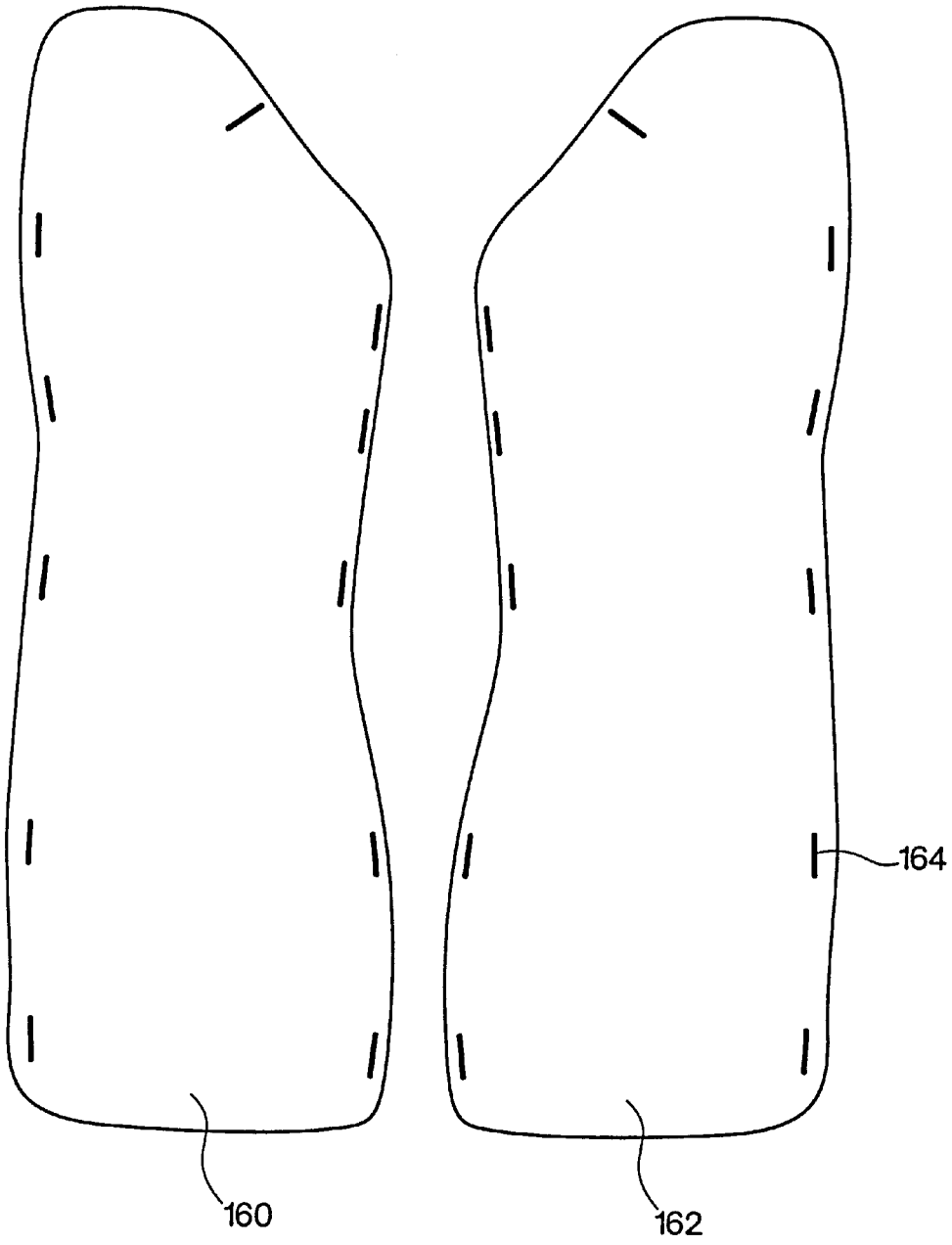
FIG. 13 is front view of a pair of chap covers for use with the garment of FIG. 1; and, FIGS. 14 and 15 are diagrammatic representations of alternative embodiments of the present invention.

According to another aspect of the invention, the garment may include a cover adapted to cover all or a portion of the side of the garment facing away from the wearer. Referring now to FIG. 13, removable covers 160, 162 are shown adapted to cover each leg section of the chaps section 34. The covers may include slits 164 to receive the straps attached to the panels. Thus, the wearer may weave the straps through the slits, thereby securing the cover to the panel. Of course, other suitable attaching means may be employed. For example, snaps, adhesives, or hook and loop fasteners may be used.

Due to the water and waste associated with water jet operations, operators of water jet lances generally wear commercial rain suits having rubber boots, plastic or rubber coated pants and hooded jacket. This rain gear becomes contaminated by sticky waste, which requires the disposal of the rain gear after a brief period of use. In addition, because of the high physical exertion associated with water jetting, full coverage protective gear and rain suits are not desirable as they tend to prevent evaporation and retain body heat.

Preferably, the covers are made of a material that economically allows the covers to be disposable, yet offer water resistance, thereby protecting the garment from dirt and grime, which may tend to reduce the useful life of the garment. An example of such a material is spun bonded olefin, which has a low cost, high tear resistance, high water resistance and high slip surface properties. In addition, little water falls on the back of the wearer's legs. Thus, preferably, the covers are adapted to cover only the front portion of the wearer, thereby maintaining a low cost and providing adequate cooling for the wearer.

Figure 14:
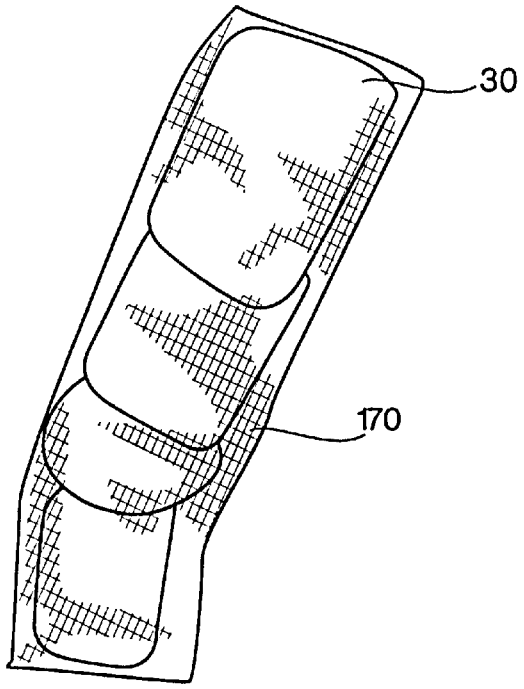
Figure 15:
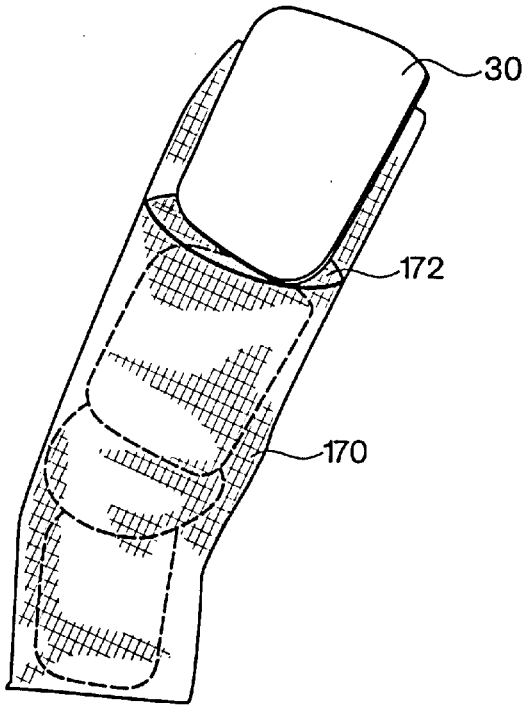

According to another aspect of the invention, the garment may include a base material adapted for wearing by a user. Such a base material may be formed as pants or a shirt which the user wears or which is strapped onto the wearer. According to this aspect of the invention, which is shown in FIG. 14 as a leg section, the panels 30 are secured to the outer surface of the base material 170 using any suitable fastening means, such as a hook and loop fastener or snaps. The panels are secured to the base material in an overlapping manner, as described above, but, in this embodiment, cooperate with the base material such that the base material may flex at an intersection between adjacent panels. Thus, in this embodiment, attaching the panels to one another may not be necessary. In a similar embodiment, which is shown in FIG. 15, the base material 170 may include at least one pocket 172. The panels 30 are placed in the pocket 172 in an overlapping manner, although, as shown in FIG. 15, one panel is being placed into the pocket while others are already inserted therein. In this example, the base material formed with a pocket provides not only the required flex for the panels, but also acts as the disposable cover.

While the best mode for carrying out the invention has been described in detail, those skilled in the art to which this invention relates will recognize various alternative embodiments including those mentioned above as defined by the following claims.

What is claimed is:

1. A penetration resistant garment comprising:

a plurality of rigid penetration resistant panels cooperating with and arranged relative to one another to provide substantially complete coverage over an area of desired coverage, each said panel comprising a penetration resistant fabric, a hardening material being disposed upon said penetration resistant fabric, said hardening material being epoxy, and a crystalline material adhered to said hardening material, said crystalline material being selected from the group of materials consisting of ceramic, garnet, metal, silicon carbide, aluminum oxide and diamond, said crystalline material has a mesh size of about approximately 150 or finer, said penetration resistant fabric being woven of high tenacity yarn with a fiber strength greater than 8 grams per denier and less that 10% elongation at break.

* * * * *